US005793391A

United States Patent [19]

Kawakami et al.

[11] Patent Number: 5,793,391

[45] Date of Patent: Aug. 11, 1998

[54] INK-JET RECORDING APPARATUS

[75] Inventors: Kazuhisa Kawakami; Keiichi Ohshima; Satoshi Fujioka; Seiji Mochizuki; Masahiro Isono; Atsushi Kobayashi, all of Nagano, Japan

[73] Assignee: Seiko Epson Corporation, Tokyo, Japan

[21] Appl. No.: 514,141

[22] Filed: Aug. 11, 1995

[30] Foreign Application Priority Data

Aug. 11, 1994 [JP] Japan ..... 6-189654
Aug. 4, 1995 [JP] Japan ..... 7-219843

[51] Int. Cl.[6] ..... B41J 2/165

[52] U.S. Cl. ..... 347/33

[58] Field of Search ..... 347/8, 12, 14, 347/22, 29, 32, 33; 346/134, 139 R; 400/55–59

[56] References Cited

U.S. PATENT DOCUMENTS

| | | | |
|---|---|---|---|
| 4,959,673 | 9/1990 | Noda | 346/140 R |
| 5,341,163 | 8/1994 | Hanabusa | 347/23 |
| 5,381,169 | 1/1995 | Arai et al. | 347/33 |
| 5,382,969 | 1/1995 | Mochizuki et al. | 347/23 |
| 5,483,267 | 1/1996 | Nemura et al. | 347/32 |
| 5,559,539 | 9/1996 | Vo et al. | 347/33 |
| 5,608,432 | 3/1997 | Yamaguchi | 347/33 |
| 5,610,636 | 3/1997 | Hanabusa et al. | 347/8 |
| 5,610,641 | 3/1997 | Ikado | 347/33 |
| 5,612,721 | 3/1997 | Ishize | 347/33 |
| 5,627,574 | 5/1997 | Fahy | 347/33 |

FOREIGN PATENT DOCUMENTS

| | | | |
|---|---|---|---|
| 0094220 | 11/1983 | European Pat. Off. | B41J 3/04 |
| 0494674 | 7/1992 | European Pat. Off. | B41J 2/165 |
| 0589582 | 3/1994 | European Pat. Off. | B41J 2/165 |
| 0604068 | 6/1994 | European Pat. Off. | B41J 2/165 |
| 62-238751 | 10/1987 | Japan | B41J 3/04 |
| 5-42675 | 2/1993 | Japan | B41J 2/165 |

OTHER PUBLICATIONS

Patent Abstracts of Japan, vol. 9 No. 14 (M–352) [1737], Jan. 22, 1985, JP–A–59 162056 (J. Arakawa) Sep. 12, 1984, abstract.

*Primary Examiner*—Adolf Berhane
*Attorney, Agent, or Firm*—Sughrue, Mion, Zinn, Macpeak & Seas, PLLC

[57] ABSTRACT

An ink-jet recording apparatus includes: an ink-jet recording head; a carriage on which the ink-jet recording head is mounted, the carriage being capable of traveling between a printing and a non-printing area, the carriage having an operating lever on non-printing area thereof; and a wiper for wiping the ink-jet recording head in the non-printing area, the wiper having a projected piece including two tilted sides, the tilted sides being projecting toward the passage in which the carriage moves when the wiper is set in position where the wiper is capable of wiping, wherein, while the carriage is moved in the directions of printing and non-printing area of the carriage, the operating lever comes in contact with the projected piece of the wiping lever so as to move the wiping means out of the traveling passage of the carriage.

9 Claims, 5 Drawing Sheets

INK-JET RECORDING APPARATUS

BACKGROUND OF THE INVENTION

1. Field of the Invention

The present invention relates to an ink-jet recording apparatus for recording data by sending a stream of drops of ink from nozzle holes in conformity with printing data, and more particularly to a mechanism of maintaining the nozzle holes.

2. Description of the Related Art

Ink-jet recording apparatus are designed so that drops of ink pressurized by piezoelectric transducers or heat generating elements in pressure generating chambers are sent out of nozzle holes. Consequently, there arise cases where dust and paper powder stick to the nozzle holes, where ink coagulates and where the nozzle holes are clogged when the holes become dried. Therefore, consequences resultant from variations in the ink-drop discharge characteristic badly affect recording heads for use in writing recording data. For the reason stated above, such an ink-let recording apparatus has been equipped with a cap member for sealing up each nozzle hole during the non-printing operation, and a cleaning unit having an elastic plate for rubbing the opening of the nozzle hole to remove dust and ink dregs during the printing operation.

With the rapid diffusion of book-type computers and portable computers such as mobile computers, there has developed a demand for the miniaturization of recording apparatus as peripheral equipment of computers.

In the case of such a miniaturized ink-jet recording apparatus, the cap member and the cleaning unit have been small-sized because a casing affords an extremely small space. It has also been arranged that the recording head is interlocked with the movement of a carriage so as to make a special driving source unnecessary for moving the recording head back and forth.

A recording apparatus that has been given in Japanese Unexamined Patent Publication No. 42675/1993, for example, is equipped with a cap member and a cleaning unit. In the recording apparatus of this type, a slider kept urged by a spring toward a printing area is made to follow the movement of a carriage and when the carriage is positioned in a non-printing area, a capping member is caused to abut against a recording head and when the recording head is moved to the printing area from the capping state, a wiping member is projected toward the recording head to perform the wiping operation. When the carriage departs from the printing area, further, the wiping means is moved back to the original position.

The aforesaid ink-jet recording apparatus is capable of not only having the capping operation performed by moving the carriage but also automatically moving the wiping means back and forth without necessitating a special driving means, whereby the ink-jet recording apparatus is made compact. In order to prevent the wiping means from bringing into contact with the recording head when the carriage is moving to the non-printing area by moving back the wiping means while the carriage is being kept away from the non-printing area, the force of the spring for urging the slider toward the printing area needs to be strong enough to keep the wiping means at the original position. However, the problem is that in a case where a small motor is used to drive the carriage in a small printer, the motor will become heavily loaded, thus accelerating the battery power consumption.

If the force of spring is set lower to counterbalance the disadvantages above, a wiper blade may be left in such a state that it has been kept forward because of trouble resulting from the suspension of the operation of the system during the wrong operation performed by the user, during carrying the recording apparatus in the wrong direction or during retracting the wiper blade to the non-wiping position. If, moreover, the recording head moved back to the non-printing area makes contact with the wiper blade thus projected, it will receive excessive wiping energy, thus causing a nozzle plate to wear away or causing the blade to become deformed.

SUMMARY OF THE INVENTION

In view of the foregoing problems, an object of the present invention is to provide an ink-jet recording apparatus capable of retracting its slider whose movement is interlocked with that of the carriage without applying useless energizing force to the slider and without wiping the recording head when the recording head is moved from a printing area to the non-printing area even though the wiping blade is kept in such a state that it becomes protruded at the wiping position for some reason.

According to an aspect of the invention, there is provided an ink-jet recording apparatus including an ink-jet recording head; a carriage on which the ink-jet recording head is mounted, the carriage being capable of traveling between a printing and a non-printing area, the carriage having an operating lever on non-printing area thereof; and a wiper for wiping the ink-jet recording head in the non-printing area, the wiper having a projected piece including two tilted sides, the tilted sides being projecting toward the passage in which the carriage moves when the wiper is set in position where the wiper is capable of wiping, wherein, while the carriage is moved in the directions of printing and non-printing area of the carriage, the operating lever comes in contact with the projected piece of the wiping lever so as to move the wiping means out of the traveling passage of the carriage.

DETAILED DESCRIPTION OF THE PREFERRED EMBODIMENTS

Figure 1:
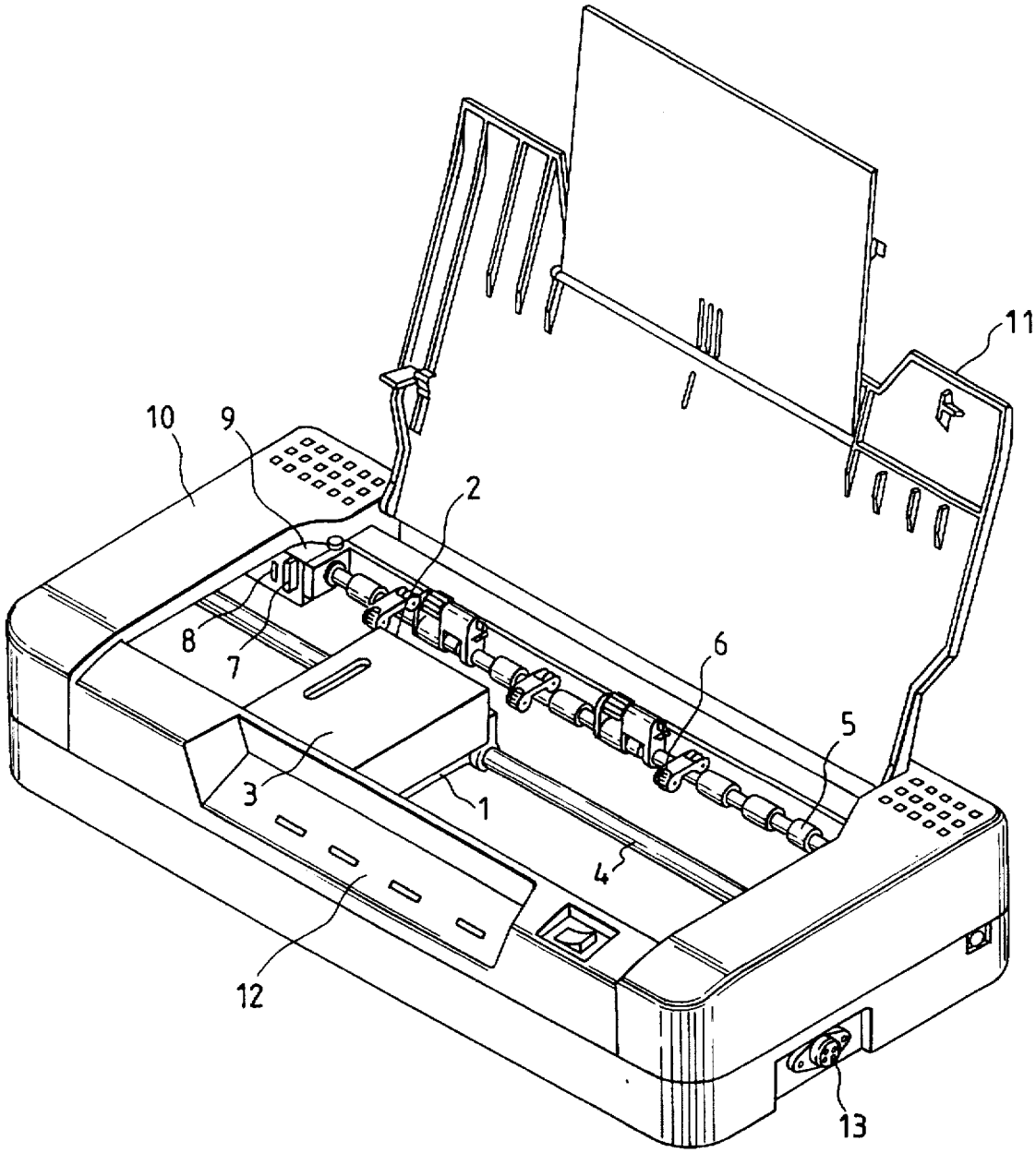
FIG. 1 is a perspective view of an embodiment of the present invention.

Referring to the drawings, a detailed description will subsequently be given of an embodiment of the present invention.

An ink-jet recording apparatus, as shown in FIG. 1 with an open outer cover 11 of a casing 10 taking away a middle cover simultaneously for use as a paper guide, is provided with a carriage 1 for carrying an ink cartridge 3 incorporating an ink-jet recording head 2, and a guide member 4 for guiding the carriage 1, the carriage 1 being reciprocated by a drive mechanism (not shown) between a printing and a non-printing area.

In the moving area of the carriage 1, a paper feed roller 5 and a paper holding-down roller 6 are installed in parallel to the guide member 4, whereas a head regenerating unit 9 having a cleaning member 7 and a cap member 8 is installed in the non-printing area. Further, reference numeral 12 in FIG. 1 denotes an operating panel; and 13, a connector connected to a host.

Figure 2:
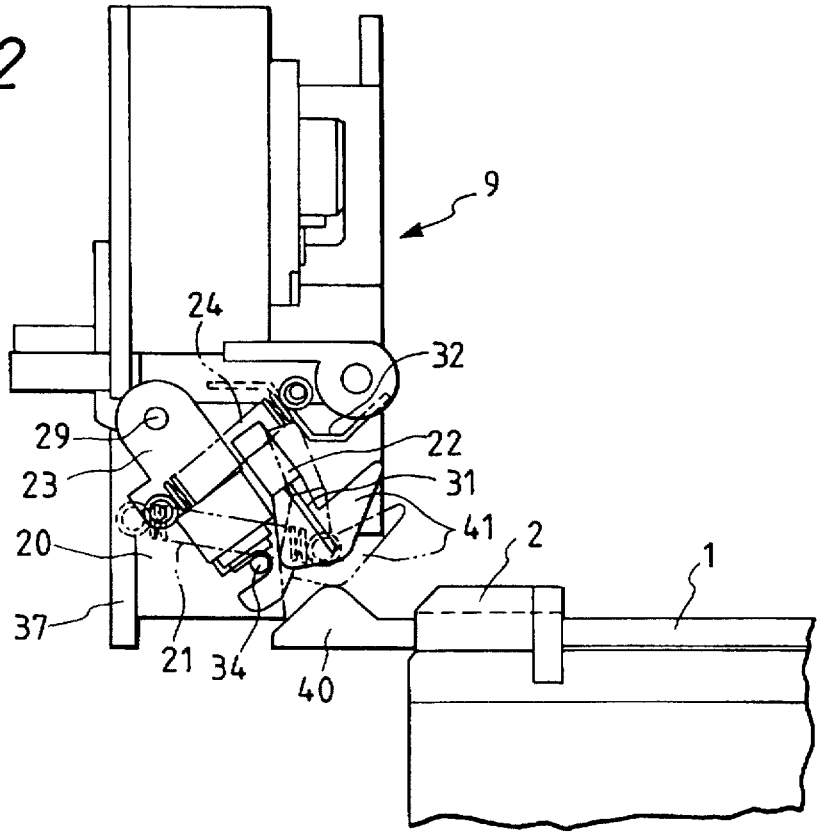
FIG. 2 is a side view of an embodiment of the head regenerating unit in the wiper reset condition of the ink-jet recording apparatus of the invention.

FIG. 2 is a view of an embodiment of the head regenerating unit of the aforesaid apparatus of the invention. The head regenerating unit 9 comprises a slider 20 serving as a moving member which abuts against part of the carriage 1 and follows in the direction in which the carriage 1 moves; a wiper lever 22 serving as a wiping means which is pivotally supported by part of the slider 20 and urged by a two-way stabilizing spring 21 so as to be pivotally displaced between the wiping and non-wiping positions; and a cap lever 23 which is made to engage with part of the slider 20 and pivotally moved between the capping and non-capping positions.

The slider 20 is installed in such a way that it is urged by a cap lever spring 24 via the cap lever 23 to stay ordinarily at the stand-by position closer to the printing area, and guided by a guide rail 26 on a unit body 25 so as to follows the movement of the carriage 1.

Figure 3:
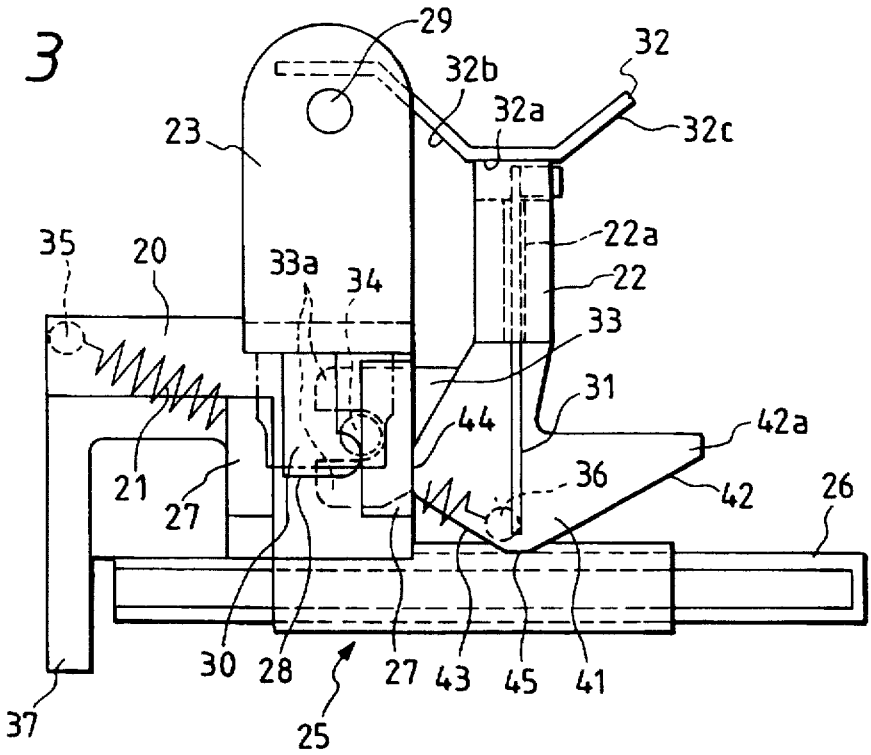
FIG. 3 is an enlarged view of the head regenerating unit in the wiper set condition of the ink-jet recording apparatus thereof.

As shown in FIG. 3, the mating portion 28 of the cap lever 23 is slidably arranged between two elevated parts 27, 27 provided in a direction perpendicular to the direction in which the slider 20 travels. Further, a cap 30 is displaced between the capping and non-capping positions by rocking the cap lever 23 pivotally supported on the shaft 29 of the unit body 25 interlockingly with the movement of the slider 20.

As shown in FIG. 3, the wiper lever 22 is provided with a slit 22*a* into which a wiper 31 in the form of a rubber or felt plate is fitted. Further, the wiper lever 22 also has a pivotal portion 33 of a fork 33*a*, 33*a* whose non-printing area side (the left-hand side of FIG. 3) is expansively opened at one-side lower end, the fork 33*a*, 33*a* being horizontally extending.

Moreover, the wiper lever 22 is pivotally supported by the slider 20 so that the former is capable of rocking. The pivotal portion 33 of the wiper lever 22 is mated with a support shaft 34 uprightly fitted to the slider 20 and the rear end (the upper end of FIG. 3) of the wiper lever 22 is kept in resilient contact with a flat spring 32 having a planar portion 32*a* with one end fixed to the unit body 25, and tilted sides 32*b* and 32*c*.

The wiper lever 22 functions as what relates the positioning of the wiper 31 to the movement of the recording head 2 and moves the wiper 31 back to the non-wiping position. The wiper lever 22 is urged by the two-way stabilizing spring 21 stretched between a pin 35 provided on the slider 20 opposite to the support shaft 34 and a fulcrum pin 36 projected at the lower end of the leading end portion of the wiper lever 22. When the two-way stabilizing spring 21 is urged toward one side with the support shaft 34 as the boundary; in other words, when the spring 21 is located above or under the support shaft 34, the wiper 31 is turned to the wiping or non-wiping position, so that the position of the wiper 31 may be stabilized.

The wiper lever 22 has a chevron projection 41 such that the projection 41 projects within the passage of an operating lever 40 provided at the end of the carriage when the wiper lever 22 is displaced toward the wiping position. There are provided tilted sides 42, 43 on the respective two sides in the direction in which the carriage 1 moves and even when the operating lever 40 makes contact with that side from any direction, the wiper 31 is rotated so as to return to the non-wiping position. Even when the side 44 situated closer to the non-printing area abuts against the side of the elevated part 27 of the slider 20, the wiper 31 is restrained from excessively rotating.

Figure 4A:
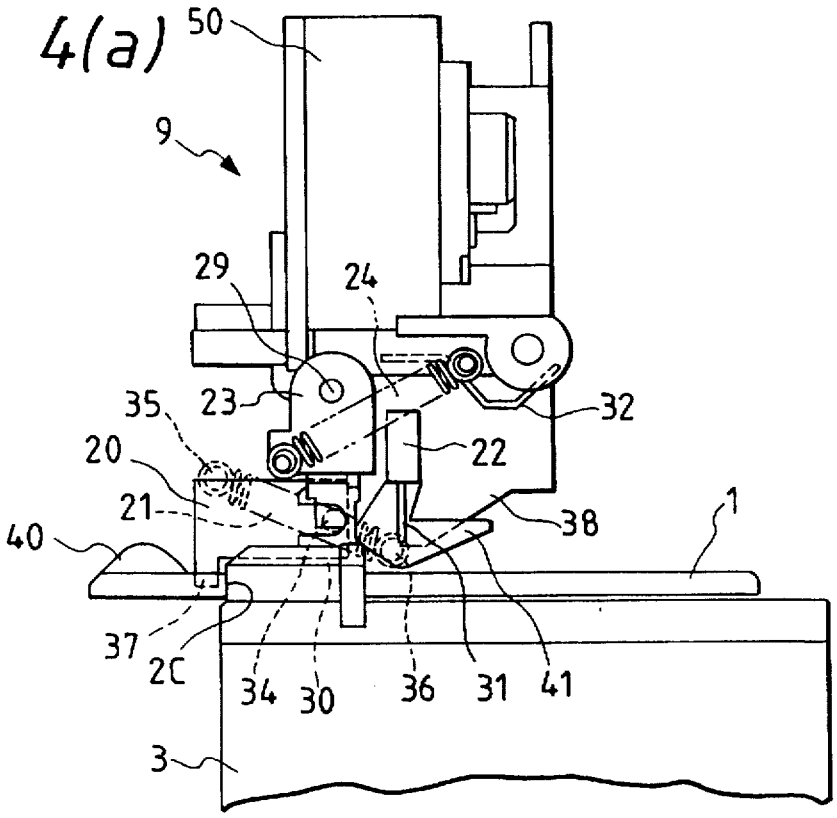
FIGS. 4(*a*) and 4(*b*) are side and elevational views of the regenerating unit in the capping condition according to the present invention.
Figure 4B:
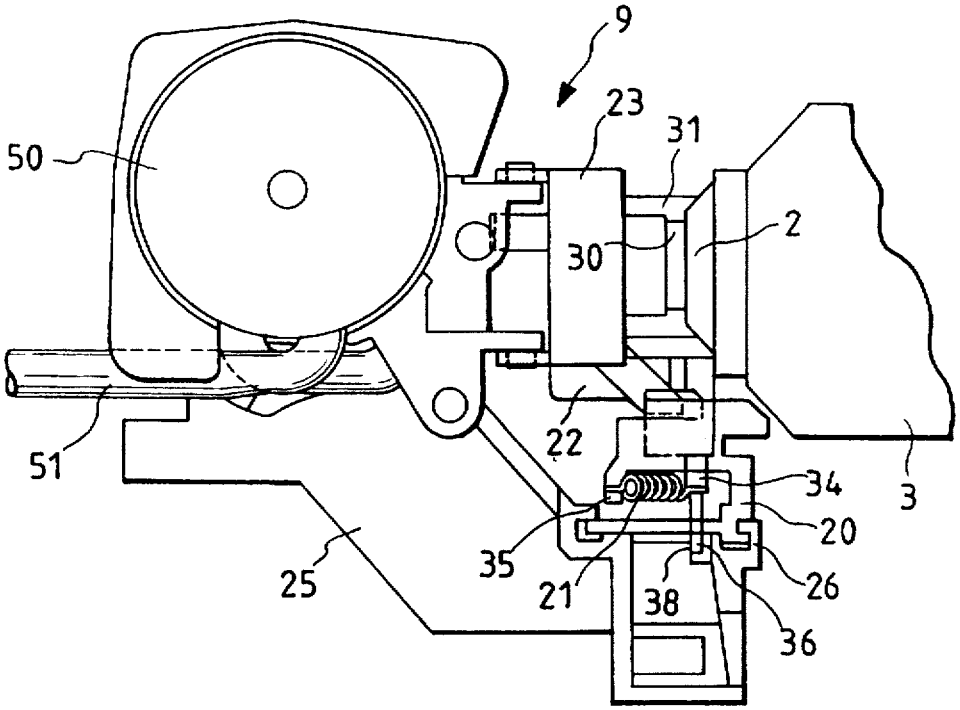

The apex of a chevron projection 40 is formed as a positioning plane 45 abutting against a reference plane 2*b* one-step lower than the nozzle plane 2*a* of the recording head 2 and when the wiper lever 22 is urged by the two-way stabilizing spring 21 to rotate clockwise as shown in FIGS. 4(*a*) and 4(*b*), the positioning plane 45 is caused to abut against the reference plane 2*b* so as to keep constant the interference quantity $\delta$ between the leading end of the wiper 22 and the nozzle plane 2*a*, irrespective of the presence or absence of an error in view of assemblage, to that optimum wiping can be carried out.

Reference numeral 50 in FIGS. 4(*a*) and 4(*b*) denotes a tube pump fitted to the unit body 25; and 51, a tube with one end coupled to the cap 30, the other communicating with a waste ink tank (not shown).

While the recording head 2 in the apparatus thus constructed is writing recording data, the slider 20 stays in the stand-by condition with its sealing side caused to face the printing area (on the right-hand side of FIG. 2) because of the cap lever spring 24 via the cap lever 23 as shown in FIG. 2.

In this stand-by condition, the wiper lever 22 rotates counterclockwise around the support shaft 34 on the slider 20 and because of the tensile strength of the two-way stabilizing spring 21 biased to the left-hand side of the support shaft 34, remains stationary after causing the chevron projection 41 to take shelter in the position indicated by an actual line of FIG. 2, that is, from the moving area of the operating lever 40.

When the carriage 1 returns to the non-printing area after completing the desired recording operation in that condition, the recording head 2 on the carriage 1 presses a projection 37 with its side 2*c* as shown in FIG. 4(*a*) and 4(*b*) to make the slider 20 move to the end of the non-printing area, that is, to the end on the left-hand side of FIG. 4(*a*) against the force of the cap lever spring 24.

Consequently, the cap lever 23 with one end pivotally supported by the shaft 29 of the unit body 25 rotates clockwise around the shaft 29 as shown in FIG. 4(*a*) and 4(*b*) and sticks the cap 30 onto the nozzle plane of the recording head 2.

The wiper lever 22 together with the slider 20 is simultaneously moved via the support shaft 34 to the non-printing area side and its upper end is separated from the flat spring 32, so that the tilted side 38 of the unit body 25 causes a fulcrum pin 36 to rotate clockwise. Consequently, the two-way stabilizing spring 21 is rotated clockwise in excess of the two-way stabilizing neutral point, and the edge face 44 of the chevron projection 41 is caused to abut against the side of the elevated part on the slider 20, whereby the wiper 22 is turned to be displaced slightly clockwise, that is, slightly away from the vertical line with respect to head 2 before being set stationary at a predetermined position (FIGS. 4(*a*) and 4(*b*)). A tube pump 50 is operated in this condition to supply negative pressure to the recording head 2 so as to force ink to be discharged for regenerating purposes.

Figure 5A:
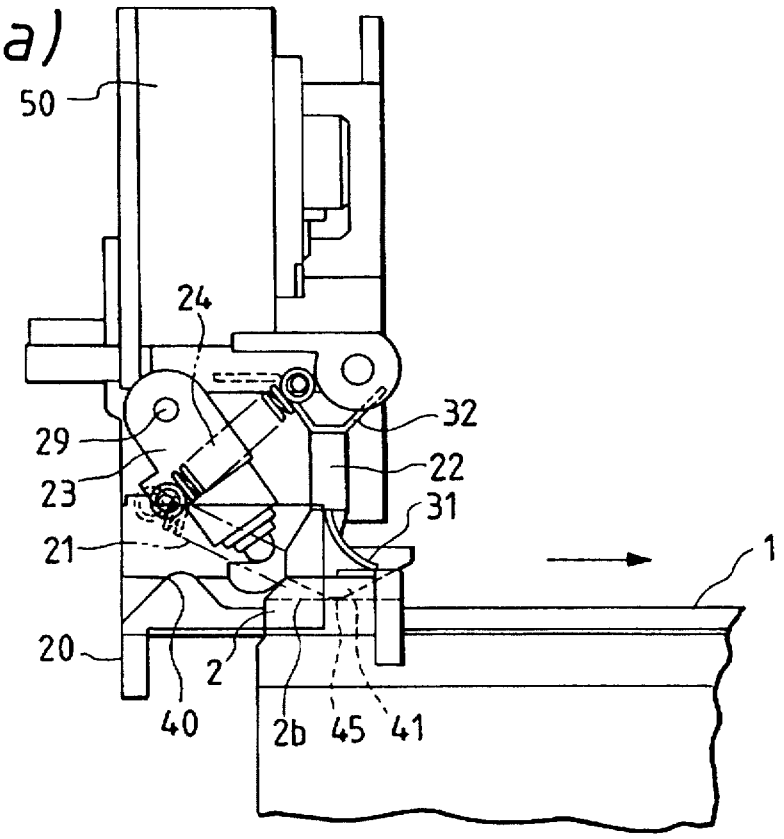
FIGS. 5(*a*) and 5(*b*) are side and elevational views of the regenerating unit in the wiping condition according to is the present invention.
Figure 5B:
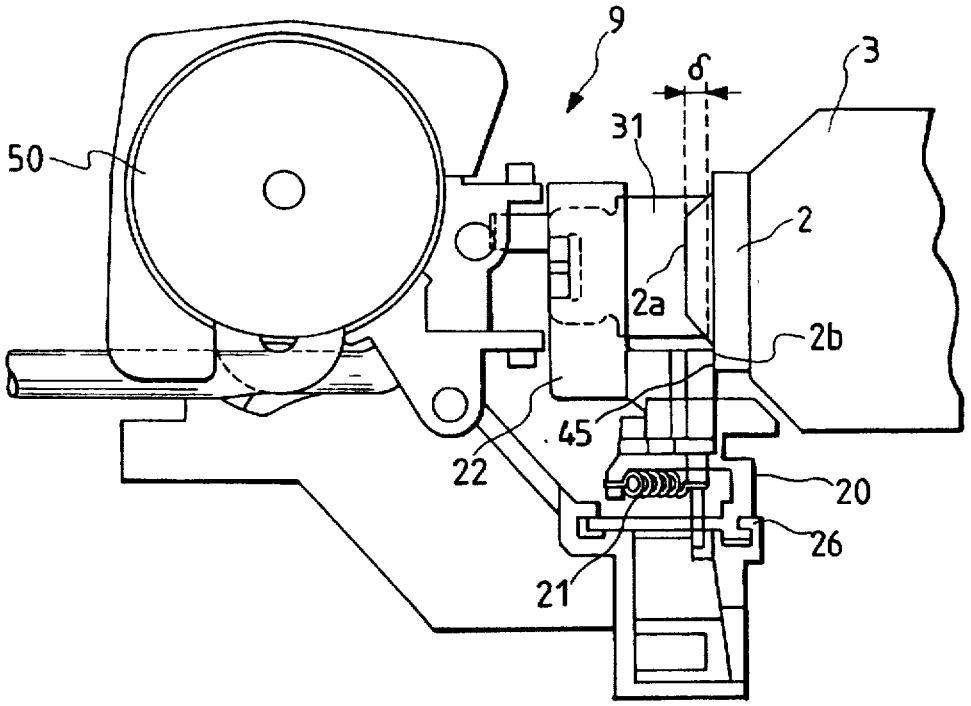

When the carriage 1 starts moving to the right-hand side, that is, to the printing area as shown in FIGS. 4(*a*) and 4(*b*) to carry out the recording and writing operation followed by the suction operation, the slider 20 in company with the cap lever 23 is displaced to the left-hand side as shown in FIGS. 5(*a*) and 5(*b*) by the energizing force of the cap lever spring 24 that acts thereon via cap lever 23.

When the slider 20 is moved, the wiper lever 22 is displaced slightly clockwise, that is, slightly away from the vertical line and held in this direction before being moved to the printing area side because of the resilient force of the two-way stabilizing spring 21 in addition to the side 44 of the chevron projection 41 in abutment with the elevated part 27 of the slider 20. At the time the slider 20 is thus moved, the positioning plane 45 at the tip of the chevron projection 41 abuts against the reference plane of the recording head 2 and keeps the predetermined interference quantity δ between the wiper 31 and the nozzle plane 2*a* of the recording head 2. When the slider 20 is moved to the right-hand end of the non-printing area in this condition, the wiper lever 22 allows its upper end to slide on the tilted side 32*b* of the flat spring 32 and slides into the planar portion 32*a*. With its resilient force, the wiper lever 22 is resiliently pressed against the recording head 2, and a blade of the wiper 31 is set perpendicular to the direction in which the carriage 1 moves.

When the carriage 1 is thus moved in the printing direction, the recording head 2 makes the wiper 31 in abutment with the nozzle plane 2*a* become arched and subjected to wiping action. While maintaining the posture, the recording head 2 together with the slider 20 is further moved to the printing area side (on the right-hand side of FIG. 5(*a*)) and separated from the wiper 31.

Figure 6A:
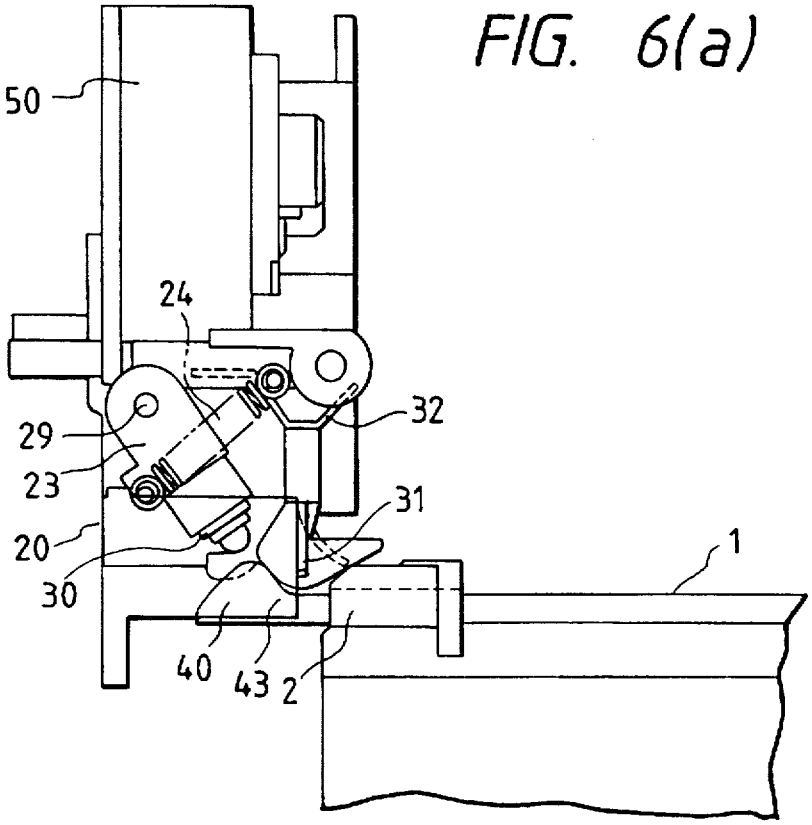
FIGS. 6(*a*) and 6(*b*) are side and elevational views of the regenerating unit in the state immediately after completion of the wiping operation according to the present invention.
Figure 6B:
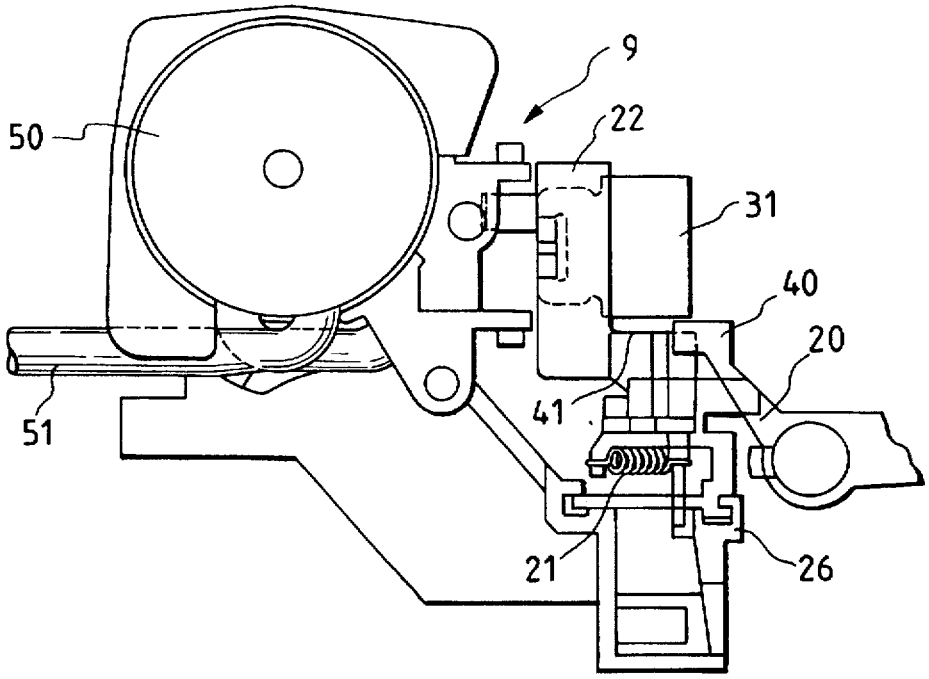

When the carriage 1 is further moved to the printing area, the operating lever 40 comes into contact with the tilted side 43 of the chevron projection 41 as shown in FIGS. 6(*a*) and 6(*b*) and rotates the projection 41 counterclockwise. Thus the wiper lever 22 is caused to rotate counterclockwise against the resilient force of the flat spring 32 and while its upper end is supported by the tilted side 32*b* of the flat spring 32, the wiper lever 22 is held in the original non-wiping position, that is, in the wiper reset position shown in FIG. 2.

In a case where the user happens to push the slider 20 toward the non-printing area by mistake while the carriage 1 is moving to the printing area, the upper end of the wiper lever 22 is separated from the flat spring 32 as noted previously. Accordingly, the fulcrum pin 36 is caused to rotate clockwise because of the tilted side 38 of the unit body 25 as well as the energizing force of the two-way stabilizing spring 21, and become perpendicular to the direction in which the carriage 1 moves.

When the user looses hold of the slider 20 in that condition, the upper end of the wiper lever 22 is held on the planar portion 32*a* of the flat spring 32 while the slider is made to return to the original position by the energizing force of the spring 24 and set to the wiping position erroneously.

When the carriage 1 is moved to the non-printing area in that condition, the operating lever 40 first comes into contact with the tilted side 42 of the printing area of the chevron projection 41 and raises the leading end 42*a*, thus forcing the wiper lever 22 to rotate counterclockwise as shown by a two-dot chain line of FIG. 2.

Thus the resilient pressure applied by the planar portion 32*a* of the flat spring 32 is removed and the wiper lever 22 is reset to the non-wiping position, whereby the following movement of the carriage 1 to the non-printing area prevents the recording head 2 from contacting the wiper 31.

When the carriage 1 is moved to the non-printing area, further, the wiper lever 22 is uprighted with respect to the movement of the carriage 1 as shown in FIG. 2, and the cap 30 is made to hermetically adhere to the nozzle plane of the recording head 2.

As set forth above, according to the present invention, there is provided with the projected piece having two tilted sides projecting in the passage in which the carriage moves when the wiping means is set in the position where the wiping operation can be performed. The carriage is equipped with the operating lever on the non-printing area side. The operating lever abuts against the projected piece when the carriage moves to the printing area and the non-printing area to make the wiping means take shelter from the travel passage. Even when the wiping means is erroneously set to the wiping position in such a state that the recording head exists in the printing area, the recording head can be moved to the capping position after the wiping means is automatically reset to the normal position at the time the carriage is reset to the non-printing area of the carriage without providing for the slider the energizing force surely strong enough to move back the wiping means. It is thus possible to prevent useless wiping from be applied to the recording head.

What is claimed is:

1. An ink-jet recording apparatus comprising:

an ink-jet recording head;

a carriage on which said ink-jet recording head is mounted, said carriage being capable of traveling between a printing and a non-printing area, said carriage having an operating lever on non-printing area thereof; and wiping means for wiping said ink-jet recording head in the non-printing area, said wiping means having a projected piece including two tilted sides, said tilted sides being projecting toward the passage in which said carriage moves when said wiping means is set in position where said wiping means is capable of wiping, wherein, while said carriage is moved in the directions of printing and non-printing area of said carriage, said operating lever comes in contact with said projected piece of said wiping lever so as to move said wiping means out of the traveling passage of said carriage.

2. An ink-jet recording apparatus according to claim 1, wherein said projected piece is kept out of the travel passage after said wiping means has wiped said recording head when said carriage is moved in the direction in which said carriage is moved in the printing area direction.

3. An ink-jet recording apparatus according to claim 2, wherein said wiping means is integratedly formed with said projected piece.

4. An ink-jet recording apparatus according to claim 1, further comprising a two-way stabilizing spring for pivotably positioning said wiping means.

5. An ink-jet recording apparatus according to claim 1, wherein said projected piece is formed of a chevron projection which is tilted in the directions of printing and non-printing areas.

6. An ink-jet recording apparatus according to claim 5, wherein said projected piece is used to regulate the interference quantity between the nozzle plane of said recording head and said wiping means.

7. An ink-jet recording apparatus according to claim 2, further comprising a two-way stabilizing spring for pivotably positioning said wiping means.

8. An ink-jet recording apparatus according to claim 3, further comprising a two-way stabilizing spring for pivotably positioning said wiping means.

9. An ink-jet recording apparatus comprising:

an ink-jet recording head;

a carriage on which said ink-jet recording head is mounted, said carriage being capable of traveling between a printing and a non-printing area, said carriage having an operating lever projecting toward the non-printing area from said carriage;

a slider following the movement of said carriage in the non-printing area;

a wiper for wiping said ink-jet recording head in the non-printing area; and a wiper-lever connecting with said wiper and pivotably supported by said slider, said wiper lever having a projected piece including two tilted sides, said tilted sides being projecting toward the passage in which said carriage moves when said wiper lever is set in position where said wiper is capable of wiping, wherein, while said carriage is moved in the directions of printing and non-printing area of said carriage, said operating lever comes in contact with said projected piece of said wiper lever so as to move said wiper out of the traveling passage of said carriage.

* * * * *